US009828806B2

(12) United States Patent
Zhang et al.

(10) Patent No.: US 9,828,806 B2
(45) Date of Patent: Nov. 28, 2017

(54) ROLLER BIT FOR ROCK BREAKING BY ROTARY CUTTING

(75) Inventors: Liang Zhang, Sichuan (CN); Shu Li, Sichuan (CN); Jialin Tian, Sichuan (CN); Defa Zeng, Sichuan (CN)

(73) Assignee: SICHUAN DEEP & FAST OIL DRILLING TOOLS CO., LTD, Chengdu, Sichuan (CN)

( * ) Notice: Subject to any disclaimer, the term of this patent is extended or adjusted under 35 U.S.C. 154(b) by 579 days.

(21) Appl. No.: 14/240,739

(22) PCT Filed: Feb. 1, 2012

(86) PCT No.: PCT/CN2012/070829

§ 371 (c)(1), (2), (4) Date: Feb. 24, 2014

(87) PCT Pub. No.: WO2013/029349

PCT Pub. Date: Mar. 7, 2013

(65) Prior Publication Data

US 2014/0202773 A1 Jul. 24, 2014

(30) Foreign Application Priority Data

Aug. 26, 2011 (CN) ..... 2011 1 0248681
Nov. 30, 2011 (CN) ..... 2011 1 0390021

(51) Int. Cl.
*E21B 10/08* (2006.01)

(52) U.S. Cl.
CPC ..... *E21B 10/08* (2013.01)

(58) Field of Classification Search
CPC ..... E21B 10/08
See application file for complete search history.

(56) References Cited

U.S. PATENT DOCUMENTS 4,936,398 A * 6/1990 Auty ..... E21B 10/14 175/336
2011/0162893 A1* 7/2011 Zhang ..... E21B 10/08 175/428

* cited by examiner

*Primary Examiner* — Brad Harcourt

(57) ABSTRACT

A roller bit for rock breaking by rotary cutting comprises: a bit body (1), a roller (2) and cutting teeth (3). An included angle β between a roller journal plane of the bit body and the roller on a bit axis has a range of $0° < \beta < 90°$, a journal offset S has a range of $-D/2 < S < D/2$, wherein D represents a diameter of the bit. Inner row of teeth rings on the bit cuts a center of a borehole bottom, and each row of teeth ring is capable of scraping a borehole wall, and thus the bit has good effects of gauge protection and sidetracking.

2 Claims, 5 Drawing Sheets

ROLLER BIT FOR ROCK BREAKING BY ROTARY CUTTING

CROSS REFERENCE OF RELATED APPLICATION

This is a U.S. National Stage under 35 U.S.C. 371 of the International Application PCT/CN2012/070829, filed Feb. 1, 2012, which claims priority under 35 U.S.C. 119(a-d) to CN 201110248681.X, filed Aug. 26, 2011, and CN 201110390021.5, filed Nov. 30, 2011.

BACKGROUND OF THE PRESENT INVENTION

1. Field of Invention

The present invention relates to technical field of equipments for petroleum and gas drilling engineering, mining, architectural engineering, tunnel engineering, shield tunneling and other trenchless engineering, and more particularly to a roller bit for rock breaking by rotary cutting.

2. Description of Related Arts

Bit is a tool which directly contacts rocks and breaks the rocks by cutting, stamping and etc. The bit widely applied in modern drilling engineering mainly includes the roller bit comprising the single roller bit and the three roller bit, and the PDC bit (Polycrystalline Diamond Compact Bit). Nowadays, both the roller bit and the PDC bit are highly developed, but there are still some insurmountable problems. A first problem thereof is that reaming may cause premature failure of the roller bit, especially the PDC bit, of a sealed bearing. A second problem thereof is that the bit causes small motion amplitude of the rocks in the center of the borehole bottom, and has insufficient function, so that the rocks are hard to break thereby, which affects penetration rate of the drill. Furthermore, the roller bit and the PDC bit have small amount of teeth provided thereon and are easy wearing, which are also the main reason for the failure of the bit.

During the process of drilling, the three roller bit breaks the rocks by impacting and crushing, wherein the teeth on the roller has an effect of impacting and crushing on rocks at the bottom hole, so as to break the rocks thereof and form a borehole diameter. Since the rocks has a much greater compressive strength than the shear and tensile strength and the three roller bit breaks the rocks utilizing the impacting effect of the teeth on the rocks, energy efficiency thereof is not high. Especially in condition with high bit pressure such as deep drilling, under the effects of the high-density drilling fluid, chip hold down effect of rock debris at the bottom hole is obvious, so it is difficult for the teeth of the bit to penetrate the rocks to impact and break the rocks. Thus rock-breaking efficiency of the three roller bit is relatively low.

Bearing life is one of the main factors restricting the life of the three roller bit. Since the bearing bears a load caused by the bit pressure, the three roller bit breaks rocks by impacting, the bearing bears a large impacting load and amplitude of the load is high. In addition, the three roller bit has an effect of speeding up, cone/bit speed ratio (a ratio of a rotating speed of a roller to a rotating speed of a bit while drilling) of the three roller bit is over 1, i.e., when the bit drills, the rotating speed of the roller is greater than the rotating speed of the bit, so the rotating speed of the bearing is relatively high, which causes that the bearing of the three roller bit has a short service life.

Roller distribution of a double-cone bit is the same with thereof the three roller bit. Working faces (cambered surfaces for distribution of teeth) of all rollers are all provided in opposite, i.e., all provided inward. Besides the problems mentioned above, analyzing the rock breaking process and the movements of the double-cone bit, the time for the teeth on the roller to contact rocks at the bottom hole is very short, and the sliding distance of the teeth at the bottom hole is small, so efficiency of rock breaking in the center is low, which affects rate of penetration.

Unlike the cono-spheroid (approximately hemispherical) hemisphere shape of the double-cone bit and the three roller bit, the roller shape of the single roller bit is nearly spherical, and working faces thereof are fully distributed on the whole spherical surface while working faces of the double-cones and the three rollers are half-arc surfaces. The single roller bit breaks rocks by impacting, rolling and scraping of the teeth on the stratum. In particular, directions of scraping movement are different in various part of the roller surface, i.e., different rows of teeth cut the stratum by sliding in a long distance along tracks in different directions, in such a manner that reticular tracks at the bottom hole are formed. Characteristics of the single roller bit is low rotating speed of the roller, large size of bearing and longer service life than the three roller bit. However, the single roller bit still has unavoidable shortcomings as follows. The packed structure of the single roller bit determines that repeated breaking and chip removal difficulty frequently occur during the process of rock breaking. Wear resistance of the teeth is gravely insufficient, and once blunt or broken occurs on the teeth, the penetration rate decreases sharply.

The PDC bits break the rocks by scraping, are widely applied in engineering of drilling, geological and construction and are getting a larger and larger application ratio during the drilling process. Under an ideal working condition that the center line of the bit is overlapped with center line of the borehole, motion trails of each tooth is a relatively fixed concentric rings girdle. Due to the differences in rock breaking mechanism and structures thereof, the PDC bits are suitable for a high drilling speed and a soft to medium hard stratum. Shortcomings of the PDC bit mainly lies in the following aspects.

1. High Requirement for the Bottom Hole Condition

If the bottom hole has external matter, tooth breakup or friction heat occurs on the PDC bit, a raised temperature scorches and blackens the matrix, or even melts the brazing layer, so that a phenomenon of teeth loosing happens, which affects the penetration rate and accelerates the failure of the bit.

2. Serious Consequences of Failure of the PDC Teeth

Compared with the roller bit, the failure of individual teeth, such as teeth lost and teeth broken, significantly increases the load of the neighborhood PDC teeth, accelerates wearing rate thereof and exacerbates the failure of the bit.

3. Low Rock-Breaking Efficiency in a Center Portion

The wear rate of PDC teeth in different radial areas of the PDC bit is significantly different. The external shoulder portion of the PDC bit cuts a larger proportion of the rocks and wear rate thereof is higher. The PDC teeth in the cone portion have a lower efficiency for contacting and breaking the rocks and thus wear rate thereof is lower.

SUMMARY OF THE PRESENT INVENTION

In view of the shortcomings of the PDC bit, the present invention improves a roller bit and provides a roller bit for rock breaking by rotary cutting, so as to solve the problems existed in the conventional double-cone bit or three roller bit such as low energy utilization, low rock breaking efficiency, short service life of the bearing, low drilling efficiency and the problems of chip removal difficulty and poor wear resistance of the teeth which are caused by a packed structure of the single roller.

The bit of the present invention impacts, crushes and cuts rocks by rotary cutting, so as to break the rocks. Furthermore, the present invention improves bearing structure of the bit, so as to ensure improving rock breaking efficiency while improving service life of the bit.

In order to overcome problems mentioned above, technical solutions of the present invention are as follows.

A roller bit for rock breaking by rotary cutting comprises: a bit body (1), a roller (2) and cutting teeth (3) provided on a working face of the roller (2), wherein an included angle β between a roller journal plane on the bit body (1) and a bit axis of the bit body (1) has a range of $0°<\beta<90°$, an journal offset S has a range of $-D/2<S<D/2$, wherein D represents a diameter of the bit.

The included angle β of the roller body and the journal offset S are as shown in FIG. 2 of the drawings, wherein a working face of the roller faces a wall and a bottom of a borehole.

In the roller bit for rock breaking by rotary cutting of the present invention, the roller faces the wall or the bottom of the borehole. During the process of rock breaking, an inner row of teeth on the roller is capable of cutting a center of the bottom of the borehole, so as to improve rock breaking efficiency of the center. Each teeth ring on the roller is capable of impacting, crushing and cutting rocks at the bottom or the wall of the borehole by rotary cutting, which is a center of the present invention.

According to the present invention mentioned above, a simulative roller bit by rotary cutting was manufactured in trail in September 2010, and is tested on a rack. An outline of the borehole bottom drilled by a simulative roller bit by rotary cutting is completely different from thereof drilled by the three roller bit or the PDC bit. Crushed zones of both the three roller bit and the PDC bit are all concentric circles, while crushed zones of the present invention are *chrysanthemum*-like helical lines. The helical lines are intensive on a borehole wall and ends up thereon, which fully proves that each row of teeth on the roller is capable of cutting the bottom and the wall of the borehole, so as to form a borehole diameter. The helical lines in a crushed zone of inner row teeth are long, and the helical lines in a crushed zone of an outer row teeth are short, in such a manner that work load of the inner and outer row teeth are balanced.

The crushed zone of the helical lines indicates the mechanism of the roller bit by rotary cutting. Each row of teeth not only has an effect of impacting and crushing, but also is capable of cutting rocks and improving rock breaking efficiency of the center as well, so as to improve rate of penetration of the bit.

Due to the way of rock breaking thereof, the roller bit for rock breaking by rotary cutting is capable of adapting various requirements of drilling, and is more preferable than conventional roller bit and diamond bit during the drilling process of sidetracking and horizontal drilling.

Based on analysis mentioned above, an increase of the journal offset S improves a radial sliding distance and an axial sliding distance of the cutting teeth on the borehole bottom, i.e., improves a total sliding distance of the cutting teeth on the borehole bottom. The included angle β of the roller body has a range of $15°\leq\beta\leq85°$, and the journal offset S has a range of $-D/4<S<D/4$, in such a manner that the cutting teeth is capable of breaking rocks by rotary cutting. Optimizing S and β is capable of achieving objects of increasing the sliding distance of the cutting teeth of the roller on the bottom and wall of the borehole and decreasing a cone/bit speed ratio of the roller body, e.g., the included angle β of the roller body is set at 30°.

Combination of the roller of the roller bit comprises, but not limited to, the following types.

1. Double-Cone Bit

Working faces of the double cones are provided outwards. The included angle β and the journal offset S respectively have a range of $0°<\beta<90°$, $-D/2<S<D/2$. Offset directions are central symmetric. The inner row teeth (the large teeth ring) of both the double cones can be set in a position of cutting center, wherein cutting center means that the teeth cut the center of the borehole, i.e., a motion trail of teeth in an outermost row of the roller reaches a position of an axis of the bit, or in other words, a longitudinal position of cutting teeth in the outermost row crosses or exceeds axis of the drill. The inner row teeth can also be set in a position of cutting center on single roller while not cutting center on the other roller by adjusting a distance of the large teeth ring to a periphery of the roller. In addition, both of the rollers can also be set to be infinitely close to cutting the center, and the center of the rocks break by impact force of the bit and internal stress of the rocks. An area of the center of the borehole which is not cut to chip directly is infinitely close to 0.

2. Three Roller Bit

Working faces of the three rollers are provided outwards. The included angle β and the journal offset S respectively have a range of $0°<\beta<90°$, $-D/2<S<D/2$. Offset directions are central symmetric. The inner teeth rows (the large teeth row) of the three roller bit are all set to be not cutting the center, and are used for bearizing.

3. Single Roller Bit

Working faces of the roller are provided outwards. The included angle β and the journal offset S respectively have a range of $0°<\beta<90°$, $-D/2<S<D/2$. Offset directions are central symmetric. The inner teeth rows (the large teeth row) of the single roller bit are set to be cutting the center.

The cutting teeth (3) of the present invention are spoon-shaped teeth, wedge-shaped teeth, spherical-shaped teeth, frustum-shaped teeth, cylindrical cutting head shaped teeth or pyramid-shaped teeth. Materials of the cutting teeth comprise cemented carbide, polycrystalline diamond compacts, thermostable polycrystalline diamond, impregnated diamond, natural diamond, cubic boron nitride or ceramic, or a mixture including cemented carbide, diamond and cubic boron nitride. The bit body (1) is a weldment, a steel assembly weldment or a sintered body of a steel body and metal powder. Structure of the roller (2) comprises a gear milling roller, an inserted teeth roller and a sintered roller of the steel and metal powder.

Compared with the prior arts, the roller bit for rock breaking by rotary cutting of the present invention has characteristics as follows.

(1) Breaking the Rocks by Rotary Cutting

During the drilling process of the bit by rotary cutting of the present invention, when the roller journal of the bit body (1) directs at the wall or bottom of the borehole, and has an included angle with the axis of the bit by rotary cutting and is offset from the axis of the bit, i.e., $\beta\neq0°$, $S\neq0$, the roller (2) impacts, crushes and cuts the rocks by rotary cutting, so as to achieve drilling for rock breaking. During the drilling process, the cutting teeth (3) of the bit by rotary cutting not only roll along with the roller to crush the stratum, but also cut the stratum by sliding process thereof on the borehole bottom, so rock breaking efficiency thereof is high. Depending on different requirements for drilling, all rows of the cutting teeth (3) on the roller (2) are not only capable of cutting a corresponding center, periphery and wall of the borehole but also drilling a shape of a borehole meeting the requirements thereof by changing included angle β of the roller body, the journal offset S and a size and a shape of the roller (2).

(2) High Performance on Breaking Center Rocks

During the process of drilling, center position of the borehole corresponding to the bit by rotary cutting is drilled by the large teeth ring. Since the large teeth ring has a greatest diameter and a maximum amount of teeth (may be over 6 times greater than teeth distribute in a center of the three roller bit) in the rings of the cutting teeth on the bit by rotary cutting, relative cutting speed thereof is high, which is capable of fundamentally solving a problem of low rock breaking efficiency in a center portion of the three roller bit and the PDC bit.

(3) Improved Penetration Rate

The structure of the bit by rotary cutting, which includes key parameters of included angle of the roller body and the journal offset S, determines forms of rock breaking thereof is impacting, crushing and cutting, and meanwhile breaking efficiency and drilling performance of the corresponding center of the borehole is high, in such a manner that the packed problem and the repeated breaking phenomenon are avoided, which is in favor of removing chips and improving penetration rate of the bit.

(4) Better Dynamic Performance

Compared with the rock breaking of the roller bit by impacting, rotary cutting bit breaks the rocks by impacting, crushing and cutting effects. Continuous cutting effects cause that the bearing bears a small impacting load and amplitude of the load decreases. In addition, cone/bit speed ratio (a ratio of a rotating speed of a roller to a rotating speed of a bit while drilling) of the three roller bit is less than 1, i.e., when the bit drills, the rotating speed of the roller is smaller than the rotating speed of the bit, so the rotating speed of the bearing is relatively low and vibrating impact of the rotary cutting bit decreases. Testing results on rack of the present invention proves that compared with the roller bit and the PDC bit of the same size and in the same working condition, the rotary cutting bit has characteristics mentioned above. The better dynamic performance results in a greater scope of application and a better control capability.

(5) Cone/Bit Speed Ratio of the Roller Bit being Less than 1, Improved Conditions Affecting Service Life of the Bearing, and Prolonged Service Life of the Rotary Cutting Bit The cone/bit speed ratio of the roller bit is less than 1 and the size of the roller journal is designed to be greater than thereof the three roller bit of the same specification. The service life of the rotary cutting bit of the present invention has significant advantages than that of the conventional roller bit. During the rock breaking process of the rotary cutting bit of the present invention, join forces generated by the bottom and the wall of the borehole push the roller to stick close to the roller journal plane, so as to improve sealing performance of the bearing and improve service life of the bearing. Since the service life of the bearing is important for the drill, the service life of the rotary cutting bit is improved.

(6) Effects of Gauge Protection

The cutting teeth rings of the rotary bit are all capable of cutting the bottom and the wall of the borehole, so as to form a borehole diameter. If a first teeth ring firstly cutting the wall of the borehole wears to become shorter, a second teeth ring takes over the work of the first teeth ring, in such a manner that the borehole is not capable of getting smaller and smaller and gauge protection is achieved. If the second teeth ring wears to failure as well, a third teeth ring is still capable of achieving gauge protection, and so on. The rotary bit of the present invention has a characteristic that all the teeth rings are capable of cutting the borehole corresponding to the rotary cutting bit, so the rotary bit has better capabilities of gauge protection and sidetracking than thereof the three roller bit, and the effect of gauge protection thereof is better.

(7) Since a Value of Offset is Set, a Packed Phenomenon does not Occur, in Such a Manner that Problems of Chip Removing and Repeated Chip Cutting are Solved.

(8) The Composite Teeth Adopted

The roller bit for rock breaking by rotary cutting can utilize cemented carbide teeth, polycrystalline diamond compacts (PDC) teeth, impregnated diamond teeth and etc. for serving as cutting teeth, wherein the service life and cutting efficiency of the teeth are all better than thereof the single roller bit.

Beneficial effects of the present invention are as follows.

The cutting teeth of the present invention break the rocks by rotary cutting. The bit of the present invention has characteristics of a high rock breaking efficiency in the center, a good gauge protection, even wearing, improved working condition of the bearing, high penetration rate and a long service life.

These and other objectives, features, and advantages of the present invention will become apparent from the following detailed description, the accompanying drawings, and the appended claims.

DETAILED DESCRIPTION OF THE PREFERRED EMBODIMENT

Figure 1:
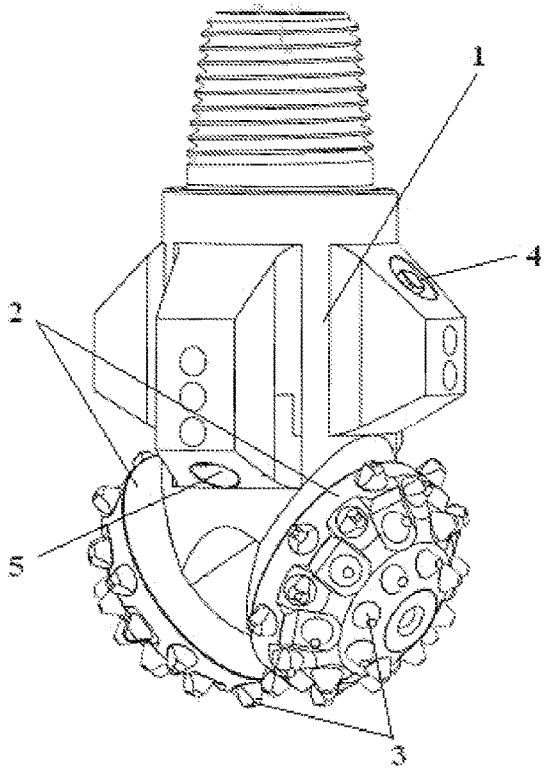
FIG. 1 is a structural schematic view of a double-roller bit adopted by the present invention, which comprises: a bit body (1), a roller (2), cutting teeth (3), a oil storage tank (4) and a nozzle (5). The bit body (1) comprises: a roller journal, a wiper block, a high-pressure slurry channel and a screw thread for connecting. The journal of the roller (2) and the bit body (1) utilizes a bearing and sealing structure commonly used in conventional three roller bits, and a plurality of cutting teeth rings are provided from a large end to a small end of the roller.
Figure 2:
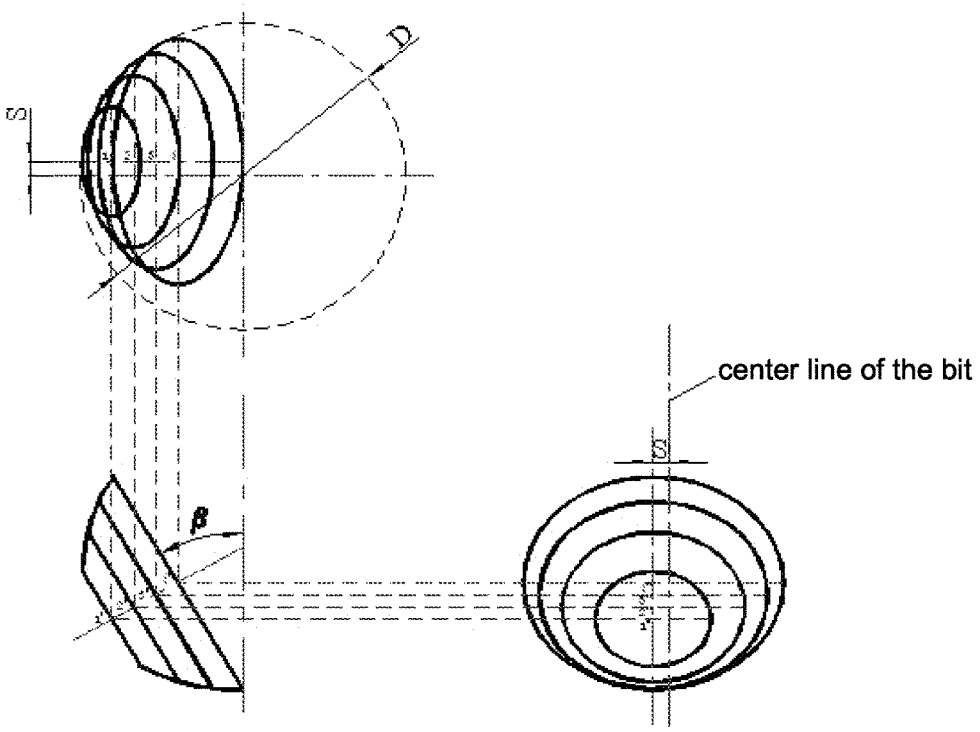
FIG. 2 is a schematic view of a cutting principle and relationships of main designed parameters of the present invention comprising an included angle β of the roller body, a journal offset S and diameter of the bit.
Figure 3:
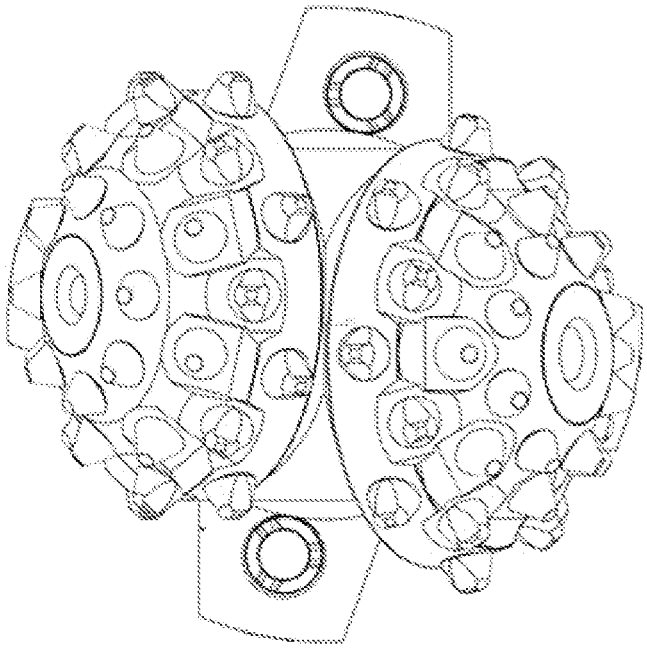
FIG. 3 is a structural schematic view of a crown, wherein a number of the roller is 2, the included angle β of the roller body=30°, the journal offset S=D/20, and one of the roller cuts a center and the other roller does not cut the center.
Figure 4:
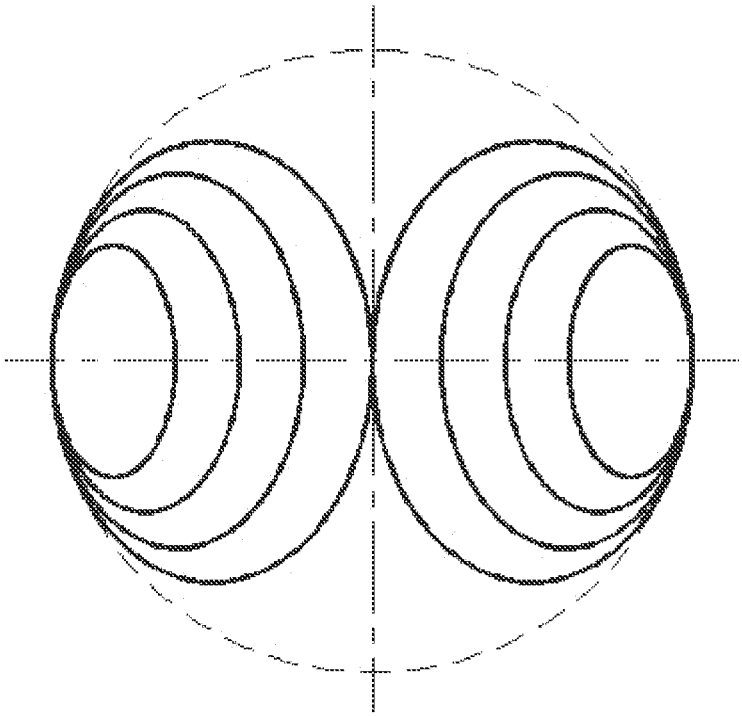
FIG. 4 is a projection schematic view of teeth rings of the rollers, wherein a number of the roller is 2, the included angle of the roller body β=30°, the journal offset S=0, and both of the rollers cut the center.
Figure 5:
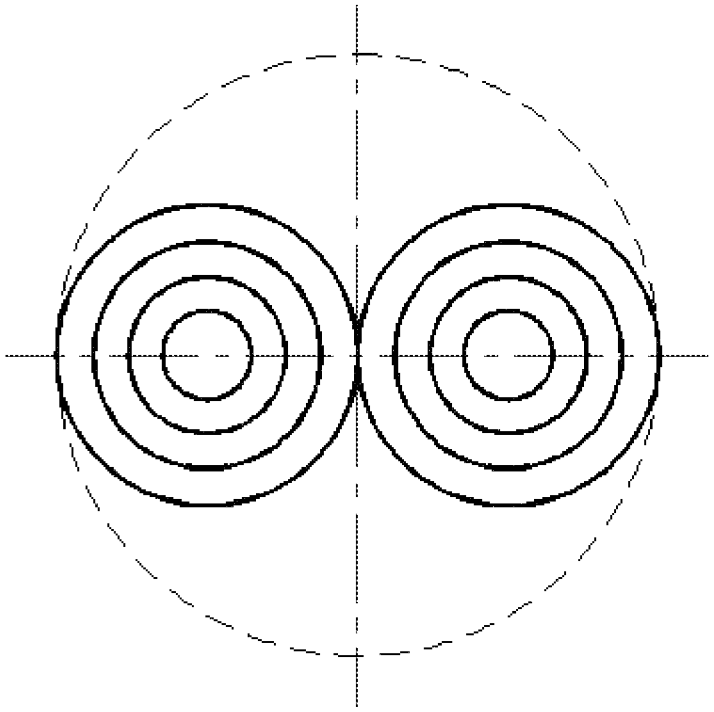
FIG. 5 is a projection schematic view of teeth rings of the rollers, wherein a number of the roller is 2, the included angle of the roller body β=89.50°, the journal offset S=0, and both of the rollers cut the center.
Figure 6:
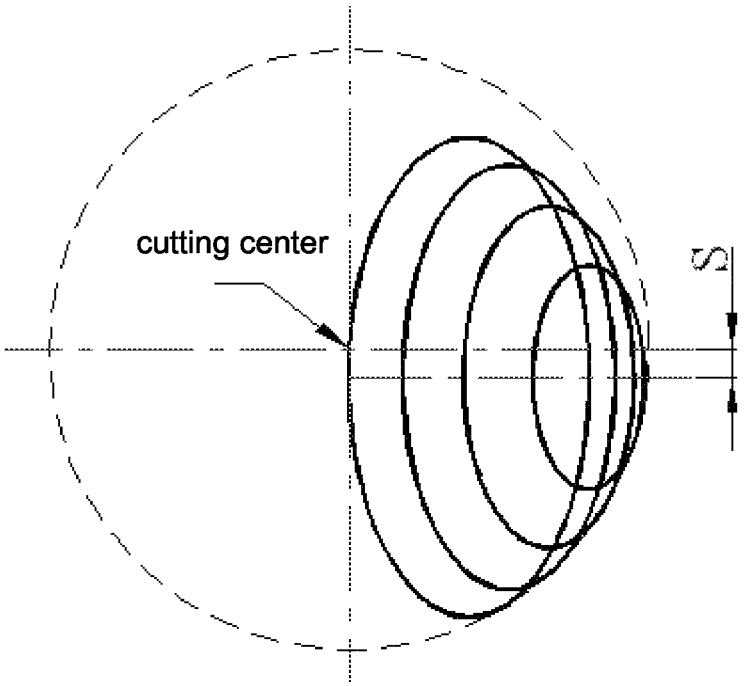
FIG. 6 is a projection schematic view of teeth rings of the rollers, wherein a number of the roller is 1, the included angle of the roller body β=30°, the journal offset S=D/20, and the roller cut the center.
Figure 7:
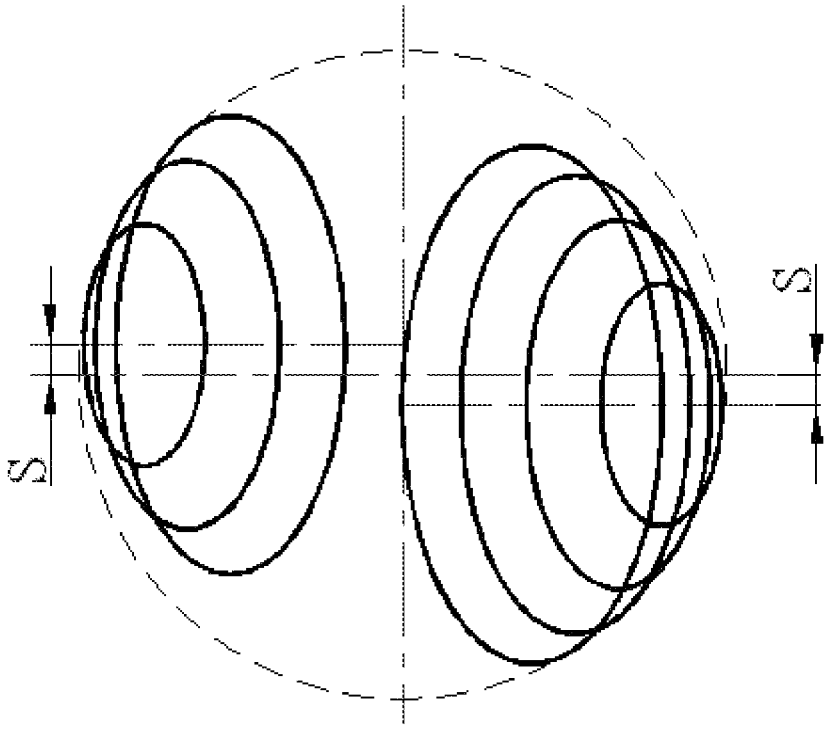
FIG. 7 is a projection schematic view of teeth rings of the rollers, wherein a number of the roller is 2, the included angle of the roller body β=30°, the journal offset S=D/20, and one of the roller cuts the center and the other roller does not cut the center.
Figure 8:
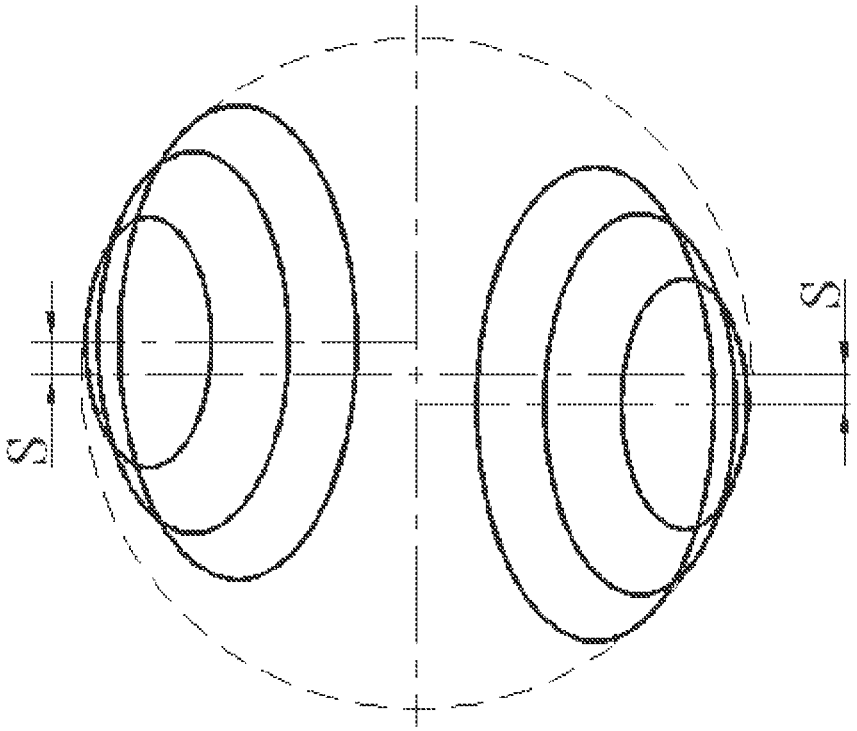
FIG. 8 is a projection schematic view of teeth rings of the rollers, wherein a number of the roller is 2, the included angle of the roller body β=30°, the journal offset S=D/20, and both of the rollers do not cut the center.
Figure 9:
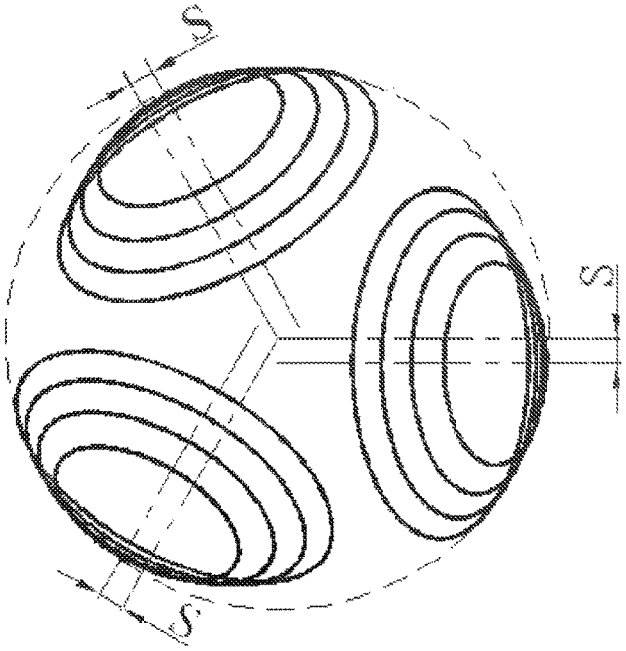
FIG. 9 is a projection schematic view of teeth rings of the rollers, wherein a number of the roller is 3, the included angle of the roller body β=30°, the journal offset S=D/20, and all of the three rollers do not cut the center.

Referring to FIGS. 1-9 of the drawings, a roller bit for rock breaking by rotary cutting, comprises: a bit body (1), a roller (2), cutting teeth (3), a oil storage tank (4) and a nozzle (5). The bit body (1) comprises: a roller journal, a wiper block, a high-pressure slurry channel and a screw thread for connecting. The journal of the roller (2) are rotatablely connected with the roller journal of the bit body (1) utilizing a bearing and sealing structure commonly used in conventional three roller bits. A plurality of cutting teeth rings are provided from a large end to a small end of the roller (2).

An included angle β between the roller journal plane and the roller body on said bit axis, which is called included angle of the roller body, has a rang of $0°<\beta<90°$ $\beta_i=\beta_{i+1}$ or $\beta_i\neq\beta_{i+1}$: an journal offset S has a range of $D/2<S<D/2$, wherein $s_i=s_{i+1}$ or $s_i\neq s_{i+1}$, wherein $\beta_i$ is an included angle of the roller body corresponding to a roller i, $S_i$ is a journal offset corresponding to the roller i, and D represents a diameter of the bit.

Embodiment 1

In the rotary cutting bit of the present invention, β=30°, S=D/20, a diameter D=4.75", a drilling rate n=180 rpm, experimental materials respectively utilize rocks of Hongya County with a size of 225×200×150 $mm^3$ and green sandstone with a size of 150×150×100 $mm^3$. During the process of the experiment, collect rock chip, analyze difficulty of the rock breaking and the vibration thereof, check wear marks of the cutting teeth and directions thereof, calculate a cone/bit speed ratio of the roller and the bit.

Both experimental results and theoretical calculation indicate that under the condition of parameters in the embodiment 1, the cone/bit speed ratio is less than 1, and actually in this embodiment, the cone/bit speed ratio is less than 0.55. The harder the rock, the higher the rotating speed of the roller and the cone/bit speed ratio.

Embodiment 2

In the rotary cutting bit of the present invention, β=30°, S=−D/20, a diameter D=4.75", a drilling rate n=180 rpm, experimental materials respectively utilize rocks of Hongya County with a size of 225×200×150 $mm^3$ and green sandstone with a size of 150×150×100 $mm^3$. During the process of the experiment, collect rock chip, analyze difficulty of the rock breaking and the vibration thereof, check wear marks of the cutting teeth and directions thereof, and calculate a cone/bit speed ratio of the roller and the bit.

Both experimental results and theoretical calculation indicate that:

when S=−D/20, the harder the rock, the lower the rotating speed of the roller, and the cone/bit speed ratio in this embodiment is less than corresponding value in the embodiment 1.

Based on comprehensive and comparative analysis of the embodiment results mentioned above, it can be concluded that optimizing the included angle β of the roller body and the journal offset S is capable of achieving objects of increasing the sliding distance of the cutting teeth of the roller on the bottom and wall of the borehole and decreasing a cone/bit speed ratio of the roller body, so as to improve rock breaking efficiency of the rotary bit and the penetration rate.

Embodiment 3

Single Roller Bit

Working face of the roller faces between the wall and the bottom of the borehole. An included angle β between a roller journal plane of the bit body (1) and a roller body on a bit axis has a range of $0°<\beta<90°$, a journal offset S has a range of $-D/2<S<D/2$, wherein the large teeth ring of the roller cuts the center.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A roller bit for rock breaking by rotary cutting comprising: a bit body (1), a roller (2) and cutting teeth (3) provided on a working face of the roller (2), wherein an included angle between a roller journal plane of the bit body (1) and a roller body on a bit axis is denoted as β, β=30°, a journal offset is denoted as S, S=D/20, a diameter D=4.75", a drilling rate n=180 rpm, wherein D represents a diameter of the bit;

wherein said included angle between said roller journal plane and said roller body on said bit axis, $\beta_i=\beta_{i+1}$ or $\beta_i\neq\beta_{i+1}$, said journal offset $s_i=s_{i+1}$ or $s_i\neq s_{i+1}$, wherein i represents a sequence number of said roller (i≥1), said included angle $\beta_i$ of said roller body is corresponding an ith roller and said journal offset Si is corresponding to said ith roller;

a cone/bit speed ratio, which is a ratio of a rotating speed of said roller to said bit, of said roller bit by rotary cutting is less than 1;

a motion trail of teeth of at least single roller reaches or crosses a position of an axis of said bit.

2. A roller bit for rock breaking by rotary cutting comprising: a bit body (1), a roller (2) and cutting teeth (3) provided on a working face of the roller (2), wherein an included angle β between a roller journal plane of the bit body (1) and a roller body on a bit axis is denoted as β, β=30°, a journal offset is denoted as S, S=−D/20, a diameter D=4.75", a drilling rate n=180 rpm, wherein D represents a diameter of the bit;

wherein said included angle between said roller journal plane and said roller body on said bit axis, $\beta_i=\beta_{i+1}$ or $\beta_i \neq \beta_{i+1}$, said journal offset $s_i = s_{i+1}$ or $s_i \neq s_{i+1}$, wherein i represents a sequence number of said roller ($i \geq 1$), said included angle $\beta_i$ of said roller body is corresponding an ith roller and said journal offset Si is corresponding to said ith roller;

a cone/bit speed ratio, which is a ratio of a rotating speed of said roller to said bit, of said roller bit by rotary cutting is less than 1;

a motion trail of teeth of at least single roller reaches or crosses a position of an axis of said bit.

* * * * *